United States Patent [19]

Bianchetta

[11] 4,112,821

[45] Sep. 12, 1978

[54] FLUID CONTROL SYSTEM FOR MULTIPLE CIRCUITED WORK ELEMENTS

[75] Inventor: Donald Louis Bianchetta, Coal City, Ill.

[73] Assignee: Caterpillar Tractor Co., Peoria, Ill.

[21] Appl. No.: 747,274

[22] Filed: Dec. 3, 1976

[51] Int. Cl.[2] ..... F15B 11/16

[52] U.S. Cl. ..... 91/6; 60/486; 91/414

[58] Field of Search ..... 91/412, 413, 414, 6; 60/427, 421, 484, 486

[56] References Cited

U.S. PATENT DOCUMENTS

| | | | |
|---|---|---|---|
| 3,709,100 | 1/1973 | Peterson | 91/447 |
| 3,720,059 | 3/1973 | Schurawski | 60/421 |
| 3,922,855 | 12/1975 | Bridwell | 91/414 |
| 3,962,954 | 6/1976 | Jacob | 91/412 |
| 3,993,158 | 11/1976 | Weight | 91/412 |
| 4,024,797 | 5/1977 | Johnson | 91/411 R |
| 4,037,620 | 7/1977 | Johnson | 91/446 |

*Primary Examiner*—Martin P. Schwadron
*Assistant Examiner*—Abraham Hershkovitz
*Attorney, Agent, or Firm*—John L. James

[57] ABSTRACT

A fluid system has at least first and second circuits each having a plurality of work elements connected in interruptible series. Control elements are provided for selectively, automatically passing fluid from one circuit to preselected positions in the other circuit in response to operation of preselected work elements.

7 Claims, 1 Drawing Figure

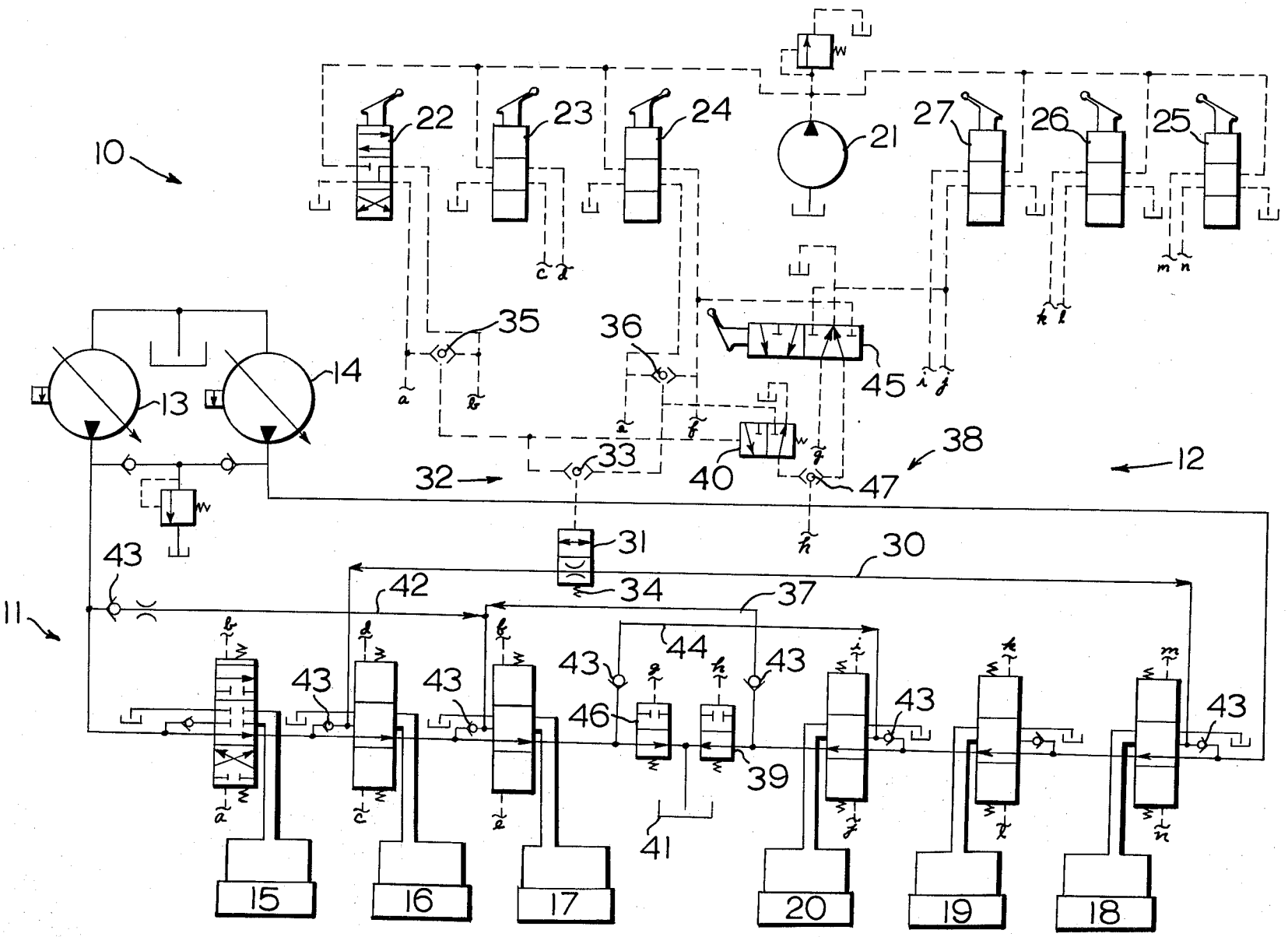
10
11
12
13
14
15
16
17
18
19
20
21
22
23
24
25
26
27
30
31
32
33
34
35
36
37
38
39
40
41
42
43
44
45
46
47

FLUID CONTROL SYSTEM FOR MULTIPLE CIRCUITED WORK ELEMENTS

BACKGROUND OF THE INVENTION

In the operation of a fluid system which serves work elements, such as for example the hydraulic system of an excavator which serves track, swing, stick, boom, and bucket work elements of the excavator, it is desirable to have a plurality of circuits and a plurality of work elements in each circuit. However, during operation of the excavator, it is often desirable to have additional fluid supplied to certain of the work elements under certain conditions. The problem then arises in being able to automatically supply this additional fluid under certain preselected conditions thereby avoiding placing additional requirements on the operator of manually manipulating additional controls to actuate the additional control elements.

The present invention is directed to overcome one or more of the problems as set forth above.

According to the present invention, a fluid system has first and second circuits each having a pump, a plurality of work elements connected in interruptible series, and a pilot pump connected to each work element through a respective control valve for controlling the operation of the work elements. A first fluid bypass line is connected at one end to the first circuit at a location between work elements of the first circuit and at the other end to the second circuit. A flow control valve is positioned in the first fluid bypass line. The flow control valve is movable between a first flow restricting position and a second open position. First means is provided for moving the flow control bypass valve to the second position in response to operation of selected work elements of the first circuit and for moving the valve to the first position in response to termination of operation of selected work elements of the first circuit. A second bypass line is connected at one end to the first circuit at a location between work elements of the first circuit and at the other end to the second circuit. Second means is provided for controllably passing fluid from the second circuit into the second bypass line in response to operation of preselected work elements of the first circuit.

BRIEF DESCRIPTION OF THE DRAWING

The drawing is a diagrammatic view of a fluid system having the apparatus of this invention.

DETAILED DESCRIPTION OF THE INVENTION

Referring to the drawing, a fluid system 10, for example a hydraulic system of an excavator, has first and second circuits 11,12. Each circuit 11,12 has respective pumps 13,14, and first, second, and third work elements 15,16,17 (first circuit), 18,19,20 (second circuit). A pilot pump 21 is connected to each work element 15–20 through a respective control valve 22–27 for selectively controlling the operation of said work elements 15–20.

A first bypass line 30 is connected at one end to the first circuit 11 at a location between work elements of said first circuit 11, for example between elements 15,16, and at the other end to the second circuit 12 at a location upstream of the first work element 18.

A flow control valve 31 is positioned in the first bypass line 30. The valve 31 is movable between a first flow restricting position shown, at which the flow of fluid through line 30 is substantially restricted, and a second open position at which the flow of fluid through line 30 is substantially unobstructed.

First means 32, comprising a resolver valve 33 and associated fluid connections, is provided for moving the flow control valve 31 to the second position in response to operation of selected work elements of the first circuit 11 and for moving the valve 31 to the first position in response to termination of operation of selected work elements of the first circuit 11.

In the preferred embodiment shown, the flow control valve 31 has a spring 34 urging the valve 31 to the first position and is connected to resolver valve 33 which in turn is connected to resolver valve 35 of the first control valve 22 of the first circuit 11 and connected to resolver valve 36 of the third control valve 24 of the first circuit 11. Pressure signals delivered to the flow control valve 31 via resolver valve 33 therefore oppose the force of spring 34 and movement of the valve 31 from the first to the second position is in response to actuation of the first and/or third work element 15,17 of the first circuit 11.

A second bypass line 37 is connected to one end of the first circuit 11 at a location between work elements of said first circuit, for example between elements 16,17, and at the other end to the second circuit 12 at a location downstream of the work elements 18–20 of said second circuit 12.

Second means 38, comprising blocker valve 39 and directional control valve 40, is provided for controllably passing fluid from the second circuit 12 into the second bypass line 37 in response to operation of preselected work elements of the first circuit, here for example work elements 15, 17.

Blocker valves 39,46 are shown in their "open to tank" position and are movable, in response to receiving a pressure signal, to their second or blocked position. Directional control valve 40 is shown in its "to tank position" and is movable, in response to receiving a pressure signal, to its shifted position.

As can be seen from the drawing, a pressure signal is delivered to the directional control valve 40 from valve 22 in response to operation of work element 15. This arrangement causes valve 40 to block any pressure signal to blocker valve 39 from valve 24 or allow a pressure signal to pass to blocker valve 39 in response to operation of work element 15. Therefore, blocker valve 39 permits fluid to flow from the second circuit 12 to tank 41 in response to the nonoperation of both work elements 15 and 17, and cause fluid to flow from the second circuit 12 into bypass line 37 in response to operation of both work elements 15 and 17.

A third bypass line 42 can be provided for delivering fluid from upstream of the first work element 15 of the first circuit 11 into the second bypass line 37 for serving the third work element 17 of the first circuit 11.

It should be noted that check valves 43 are associated with respective lines 30,37,42,44 for maintaining the direction of flow in said lines in the directions indicated by the arrows.

A manually operated selector valve 45 can be provided for passing fluid from the first circuit 11 at a location downstream of the last work element 17 into the second circuit at a location upstream of work element 20. Valve 45 is shown in the tank position at which signals from control valves 24 and 27 are blocked and said valve 45 is manually shiftable to a second position at which signals from control valves 24,27 can pass respectively to blocker valve 39 via resolver 47 and to blocker valve 46, thereby selectively, controllably directing excess fluid from the tail end of each circuit 11,12 to the other circuit.

For purposes of simplicity in comprehending the operation of the fluid system of this invention, in the first circuit 11 the first work element is a swing 15, the second work element is left track apparatus 16 and the third work element is a stick 17, and in the second circuit 12 the first work element is right track apparatus 18, the second work element is a bucket 19 and the third work element is a boom 20. The work elements 15–17 of the first circuit 11 and the work elements 18–20 of the second circuit 12 are connected in interruptible series, as set forth above.

By the construction of the fluid system of this invention, fluid is automatically directed from one position in one of the circuits to another position in the other circuit in response to the operation of the various work elements. The following table is provided to set forth some of the various modes of operation of the system. Other modes of operation can easily be discovered by a study of the drawing and specification.

TABLE

| Work Elements in Operation | Element No. | Position | Effect on Associated Elements: Element No. | Effect |
|---|---|---|---|---|
| 15,16,18 | 31 | 2nd Position | 39 | Open to tank |
| | 40 | Shifted Position | 46 | Open to tank |
| | | | 16 | Receives fluid via line 30 and any excess fluid from 15 |
| 16,18 | 31 | 1st Position | 39 | Open to tank |
| | 40 | To Tank Position | 46 | Open to tank |
| | | | 16,18 | Receives equalizing fluid pressure via line 30 as needed |
| 15,17 | 31 | 2nd Position | 39 | Blocked |
| | 40 | Shifted Position | 46 | Open to tank |
| | | | 17 | Receives fluid from 2nd circuit via lines 37, from line 42, and excess fluid from 15 |
| 15,16,17,18 | 31 | 2nd Position | 39 | Blocked |
| | 40 | Shifted Position | 46 | Open to tank |
| | | | 16 | Receives fluid from 2nd circuit via line 30, excess fluid from 15 |
| | | | 17 | Receives excess fluid from 18 via line 37, fluid from line 42, and excess fluid from 16 |
| 20 | 31 | 1st Position | | |
| | 40 | Tank Position | 39 | Open to tank |
| | 45 | 2nd Position | 46 | Blocked |
| | | | 20 | Receives fluid from 1st circuit via line 44 in conjunction with 2nd circuit |
| 17 | 31 | 2nd Position | | |
| | 40 | Tank Position | 39 | Blocked |
| | 45 | 2nd Position | 46 | Open to tank |
| | | | 17 | Receives fluid from 2nd circuit via line 37 and fluid from first circuit |

It should be understood, however, that the control elements of this invention, namely elements 31,40,45, can be constructed to receive signals from other work elements and be positioned at other locations in the fluid system without departing from this invention. Further, there can be additional control elements for automatically rerouting the fluid without departing from this invention.

Other aspects, advantages, and objects of this invention can be obtained from a study of the drawing, the disclosure, and the appended claims.

The embodiments of the invention in which an exclusive property or privilege is claimed are defined as follows:

1. In a fluid system having at least first and second circuits each having a fluid source, a reservoir, a plurality of work elements connected in interruptible series, a work fluid pathway for each circuit, said work fluid pathways comprising a passageway connecting each source to the work elements of the respective circuit and to the reservoir, and a pilot pump connected to each work element through a respective control valve for controlling the operation of said work element, the improvement comprising:

a first bypass line separate from said work fluid pathways and being connected at one end to the first circuit at a location between work elements of said first circuit and at the other end to a preselected location on the second circuit;

a flow control valve positioned in the first bypass line, said flow control valve being movable between a first flow restricting position and a second open position;

first means for moving the flow control valve to the second position in response to operation of selected work elements of the first circuit and for moving the valve to the first position in response to termination of operation of selected work elements of the first circuit;

a second bypass line separate from said work fluid pathways and being connected at one end to the first circuit at a preselected location and at the other end to a preselected location on the second circuit; and second means for controllably passing fluid from the second circuit into the second bypass line in response to operation of preselected work elements of the first circuit.

2. A fluid system, as set forth in claim 1, including:

a third bypass line having one end connected to the first circuit at a location upstream of the work elements of said first circuit and the other end connected to the second bypass line.

3. A fluid system, as set forth in claim 2, wherein the first circuit has at least three work elements connected in interruptible series with the first bypass line connected to the first circuit between the first and second work elements and the second bypass line connected to the first circuit between the second and third work elements.

4. A fluid system, as set forth in claim 1, wherein the first circuit has at least three work elements connected in interruptible series with said first bypass line connected to the first circuit between the first and second work elements and the second bypass line connected to the first circuit between the second and third work elements.

5. A fluid system, as set forth in claim 1, wherein the first circuit has at least three work elements connected in interruptible series and the first means comprises:

a resolver valve connected to the respective control valves of the first and third work elements and to the flow control valve of the first bypass line.

6. A fluid system, as set forth in claim 1, wherein the first circuit has at least three work elements connected in interruptible series and the second means comprises:

a blocker valve in the second circuit at a location downstream of the work elements of said second circuit; and a directional control valve connected to the first and third work elements of the first circuit and to the blocker valve of the second circuit and being of a construction sufficient for passing fluid from the second circuit into the second bypass line in response to operation of both first and third work elements of said first circuit.

7. A fluid system, as set forth in claim 1, including:

means for passing fluid from the first circuit downstream of the last work element into the second circuit in response to manual positioning of a selector valve.

* * * * *